US009894929B2

(12) United States Patent
Mehio

(10) Patent No.: US 9,894,929 B2
(45) Date of Patent: Feb. 20, 2018

(54) HOOKAH

(71) Applicant: Mya Saray, LLC, Sterling, VA (US)

(72) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 554 days.

(21) Appl. No.: 14/621,367

(22) Filed: Feb. 12, 2015

(65) Prior Publication Data

US 2016/0235116 A1 Aug. 18, 2016

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS

2005/0279371 A1* 12/2005 Billard ..... A24F 1/30 131/185
2012/0118304 A1* 5/2012 Mehio ..... A24F 1/30 131/328

* cited by examiner

*Primary Examiner* — Eric Yaary
(74) *Attorney, Agent, or Firm* — Da Vinci's Notebook, LLC

(57) ABSTRACT

A hookah is disclosed wherein the stem connects internally to a bottle. A gauge positioned on the stem depicts an indication level with a crown portion of the hookah bottle. When the indication level has been reached, the stem connection point—which may or may not be visible—has been reached.

19 Claims, 13 Drawing Sheets

HOOKAH

FIELD OF THE INVENTION

The present invention relates to the field of hookahs and more specifically to the field of fragile smoking articles.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners that followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a bottle, a stem, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah bottle, which is a cavern containing water. The bottle of the hookah is typically fabricated of glass or plastic and tends to be the most expressive portion of the hookah, ranging from translucent to wildly-colored. Within the cavern of the hookah bottle, the massell smoke is cooled by the water within. The cooled massell smoke then returns to the stem, though not through the same entrance by which the massell smoke enters the bottle. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

One generally constant theme of hookahs is the point of affixation between the bottle and the stem: the stem attaches to the bottle at the bottle's rim. The stem can affix in numerous ways. The stem may rest on the top of the bottle, the stem may attach via interference fit to the top of the bottle, the stem may be screwed on the bottle either internally or externally, or the stem may sit on the bottle using only gravity.

SUMMARY

The present invention is directed to a hookah. The hookah includes a bottle and a stem. The bottle can be logically subdivided into three regions, a receptacle, a neck, and a crown. The stem includes at least a gauge and a plunger. The plunger is a lower part of the stem that is submerged internally within the bottle with a seal for internal affixation to the neck of the hookah. The gauge is a predetermined height above the affixation seal and acts as a display to inform the user the depth that the plunger has been submerged.

An advantage of the present invention is that it obviates the need for affixation in a visible area or affixation between durable materials. Affixation may occur between a stam and the delicate materials frequently used to manufacture a hookah bottle, e.g. glass and crystal. In one embodiment of the present invention the gauge includes a geometric shape that geometrically corresponds to the interior of the hookah crown; the stem is pushed down into the bottle until the gauge forms a clearance fit relationship with the crown. In another embodiment, the hookah crown includes a slanted sidewall that permits a user to align the approximate center of the gauge with the approximate center of the crown sidewall. In another embodiment, the hookah neck includes sidewall graphics, or other opaque condition, that obscure the point of attachment between the stem and the bottle.

Therefore, it is an aspect of the present invention to permit affixation of stem to a hookah bottle without direct visibility of the attachment point between the stem and bottle. It is a further aspect of the present invention to permit construction of hookah bottles lacking durable materials.

It is a still further aspect of the present invention to permit construction of hookah bottles with enhanced surface ornamentation.

It is a still further aspect of the present invention to permit construction of hookah bottles with less design limitations, particularly at the apex thereof.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
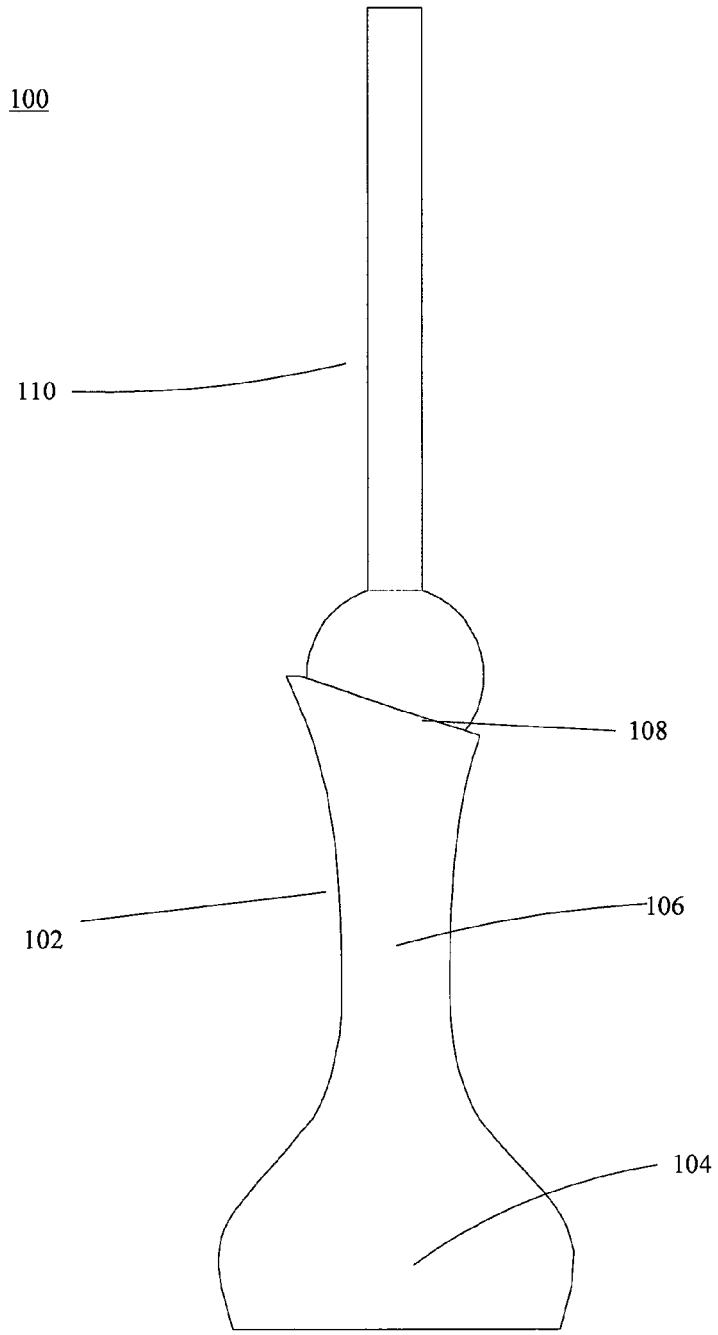
FIG. 1 is a front perspective view of a hookah embodiment of the present invention.
Figure 2:
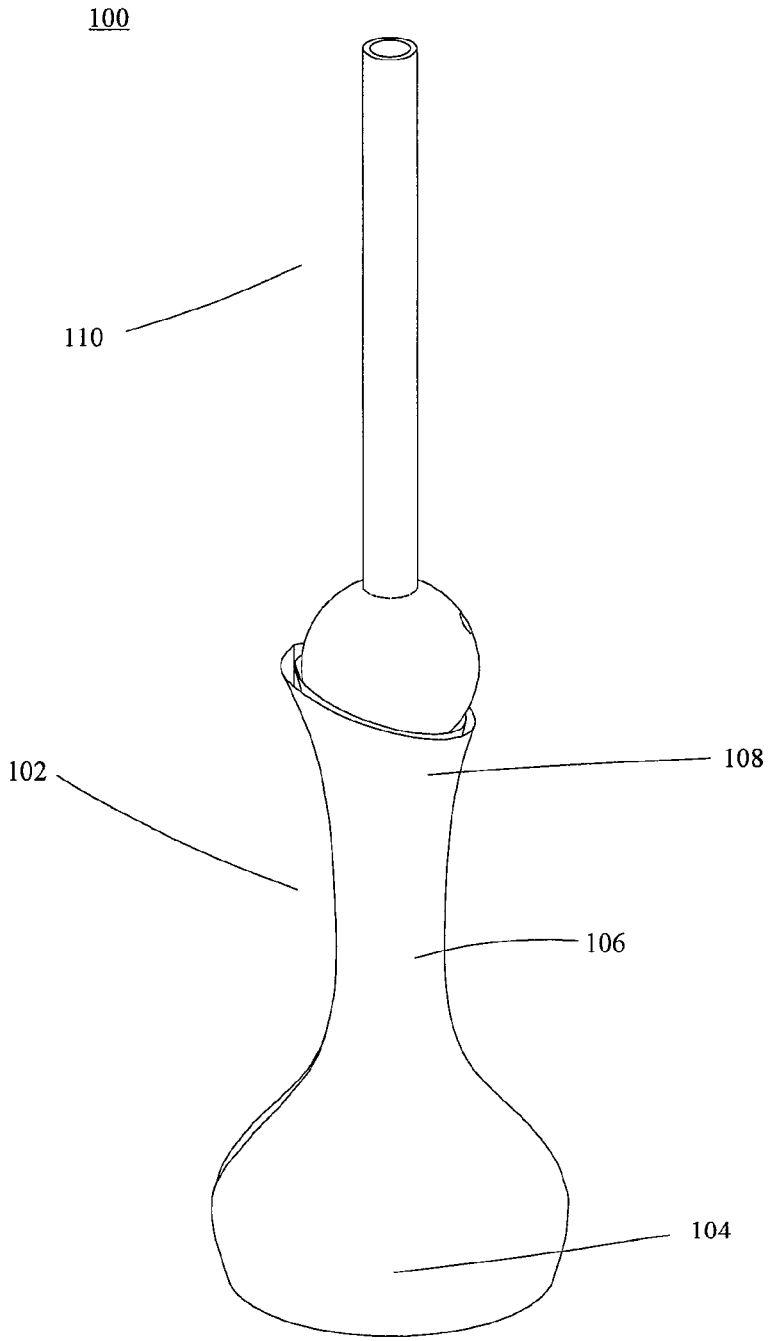
FIG. 2 is an upper, perspective view of a hookah embodiment of the present invention.
Figure 3:
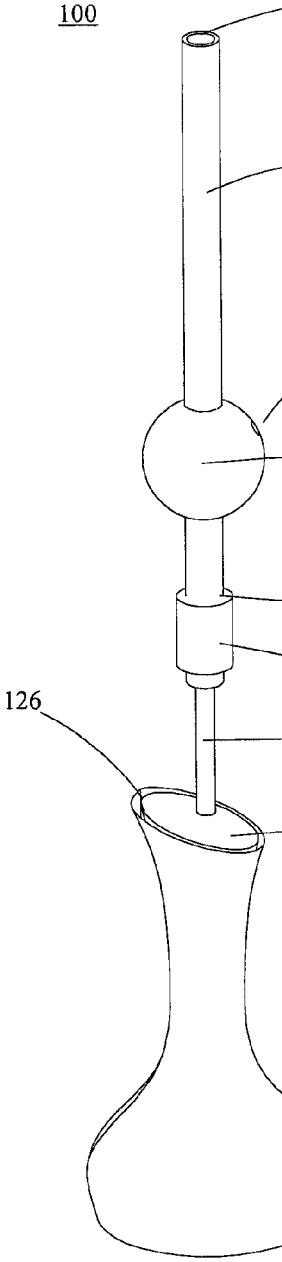
FIG. 3 is an upper, perspective view of a hookah embodiment of the present invention.
Figure 4:
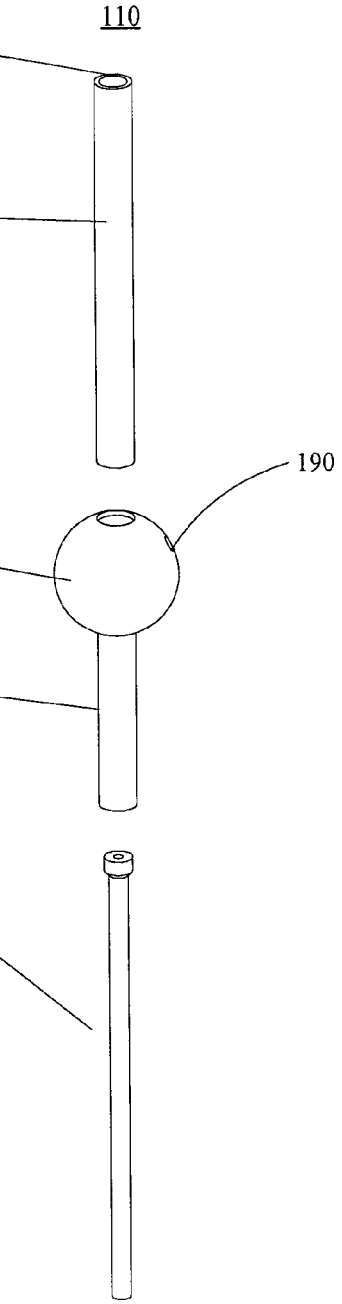
FIG. 4 is an upper, exploded view of a stem of a hookah embodiment of the present invention.
Figures 5, 6:
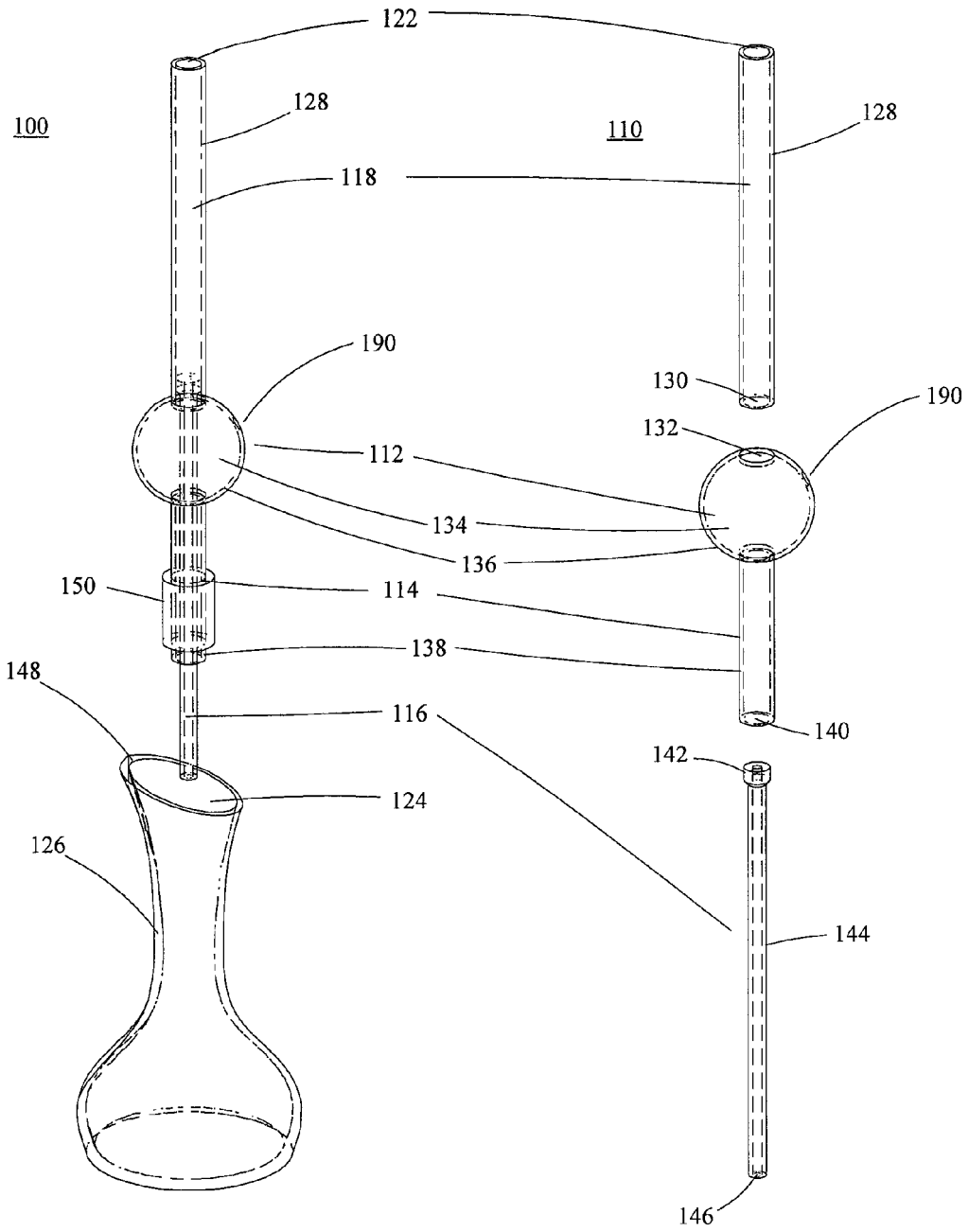
FIG. 5 is a revealed, perspective view of a hookah embodiment of the present invention.
FIG. 6 is a revealed, exploded view of a stem of a hookah embodiment of the present invention.

Referring first to FIGS. 1 and 2, a basic embodiment of the hookah 100 is shown. The hookah includes a stem 110 and a bottle 102. The bottle 102 can be conceptually subdivided into at least three regions, a receptacle 104, a neck 106, and a crown 108. The bottle 102 may be constructed of any material commonly used in the fabrication of hookah bottles; however, the present invention has certain features that make it advantageous in the expanded use of delicate materials for hookah bottle construction. The receptacle 112 is the portion of the bottle that holds liquid (not shown) for the cooling of tobacco smoke. The receptacle 112 is generally bulbous for the retention of a substantial amount of water. The neck 106 of the present invention is between the crown 108 of the bottle and the receptacle and is characterized as being a narrow point of the bottle. The crown of the present invention includes that portion of the bottle above the neck 106 that extends to the highest point of the hookah bottle. It is preferred that the receptacle 104 and crown 108 be flared towards their respective extremities. It is preferred that the bottle includes dimensions such that the receptacle includes a larger diameter than the neck, and the crown includes a larger diameter than the neck. The use of "diameter" is meant to be inclusive of all continuous geometric shapes, from squares, rectangles, rhomboids, octagons, circles, etc.

Turning now to FIGS. 3-6, the hookah stem 110 fits into the hookah bottle 102. The rim 148 of the hookah bottle 102 lacks any particular attachment means as the present invention obviates the necessity for visible attachment means positioned on the top of a hookah bottle. The stem 110 of the present invention includes a plunger 114, a gauge 112, dry smoke intermediate tube 118 (so called because it is between a burner and a down tube), and a down tube 116. Smoke may enter the present invention from a hookah bowl into the dry smoke intermediate tube 118. The dry smoke intermediate tube transports dry smoke downward from the bowl toward the hookah bottle 102. Prior to reaching the hookah bottle 102, the dry smoke will pass through the stem 110 to a portion thereof that possesses the stem gauge 112.

The stem gauge 112 provides measurement functionality for the correct placement of the stem 110 within the hookah bottle 102 by the creation of a level indication. The stem gauge 112 need not include any particular interior configuration, as its functionality is correlated to the gauge's exterior geometric shape and the geometric shape of the bottle crown. The gauge 112, as is the case in the depicted embodiment, may be the exterior manifestation of a hookah plenum 134 in the stem base. In FIGS. 1-7, the stem base is simply the combination of the plunger 114 and the gauge 112. The stem base of a hookah includes the components wherein a horizontal sliver would reveal both wet and dry smoke. A plenum includes that portion of the stem base wherein wet smoke first accumulates from the bottle for distribution to the hookah hose. A plenum may be constructed to include discrete passages for wet smoke rising from the bottle as is customary in the art, or a unitary passage for wet smoke collection as is depicted in U.S. Pat. No. 8,001,978, the contents of which are hereby expressly included by reference. The preferred plenum of the present invention includes an open interior with a unitary wet smoke passage. Wet smoke, rather than ascending through discrete wet smoke passages, ascends through the annular channel formed by the connection of the down tube 116 to an upper portion of the plenum, and more preferably, to the lower portion 130 of the dry smoke tube 118. Wet smoke exits the hookah body to a hookah hose through a wet smoke outlet 190, which in the preferred hollow plenum need only be a hole directly drilled in the side. A hookah hose (not shown) may directly connect to the wet smoke outlet, or the wet smoke outlet may lead indirectly by way of another component to a hookah hose.

Smoke continues its descent through the hookah stem into the down tube 116. As previously mentioned, under the preferred version of the stem of the present invention, dry smoke will travel directly from the dry smoke tube 118 to the down tube. The upper portion 142 of the down tube 116 preferably connects to the interior lower portion 130 of the dry smoke tube 118 via a threaded connection. The preferred down tube 116 carries the dry smoke through the plenum and through the plunger such that the dry smoke contacts neither the sidewall 136 of the plenum or the sidewall 138 of the plunger. The down tube descends well into the hookah bottle to contact liquid contained therein. Dry smoke exits the lowermost portion 146 of the down tube into the bottle receptacle.

Smoke wetted from liquid within the bottle receptacle ascends into the stem plunger 114, which may or may not be integrated into the gauge 112. The stem plunger 114 includes that portion of the stem base that is underneath the gauge and connects to the hookah bottle. The stem plunger submerges within the interior of the bottle for purposes of attachment. In the preferred version of the plunger, the plunger includes a hollow interior void devoid of minute discrete passages. The single interior void permits water vapor to ascend uniformly into the plenum while allowing a down tube to extend well into the bottle receptacle to channel dry smoke into liquid therein. The plunger includes a sturdy sidewall 138, preferably constructed of stainless steel. The plunger includes a geometric shape and orientation complementary to the shape and orientation of the neck of the hookah bottle, at least for that portion of the plunger that connects to the neck.

Figure 7:
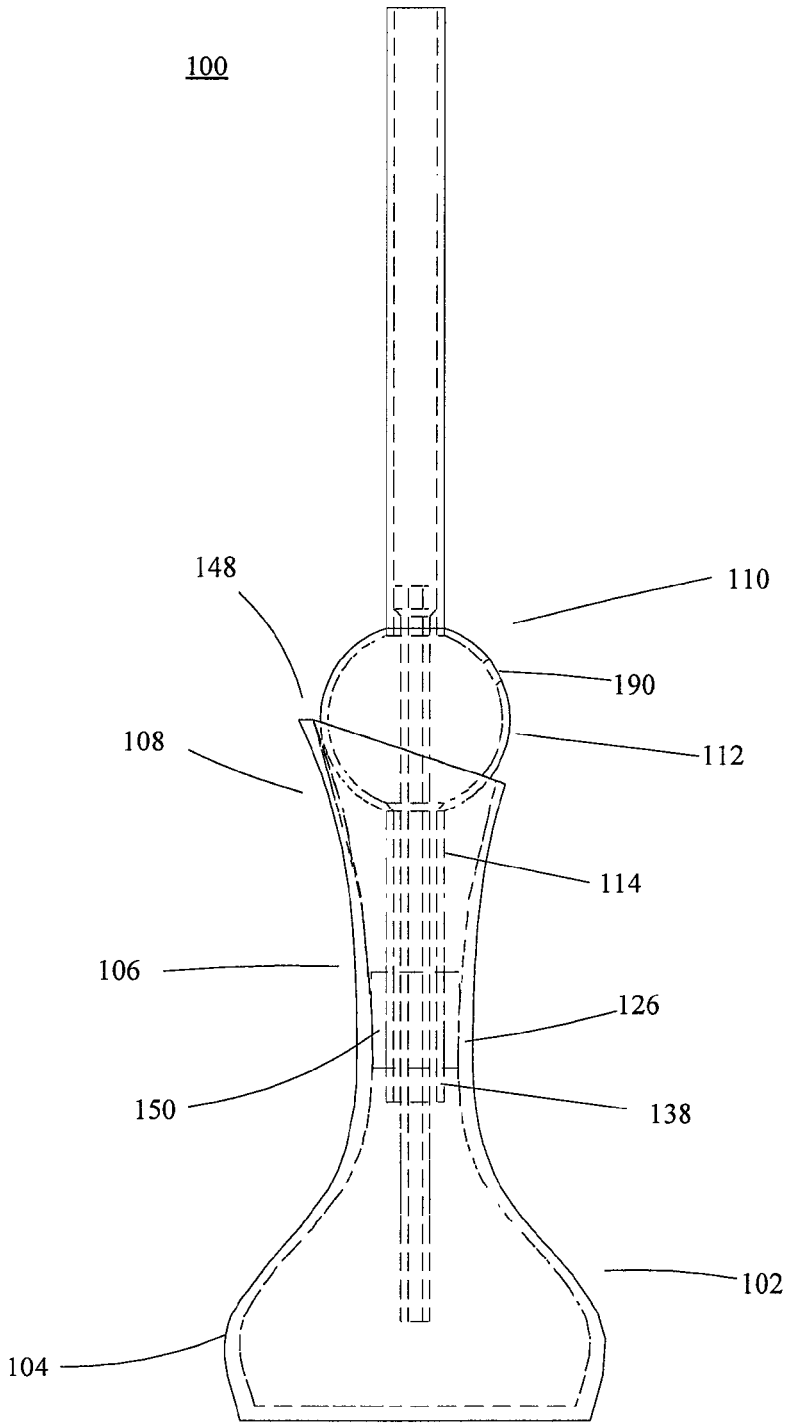
FIG. 7 is a front, revealed, perspective view of a hookah embodiment of the present invention.
Figure 8:
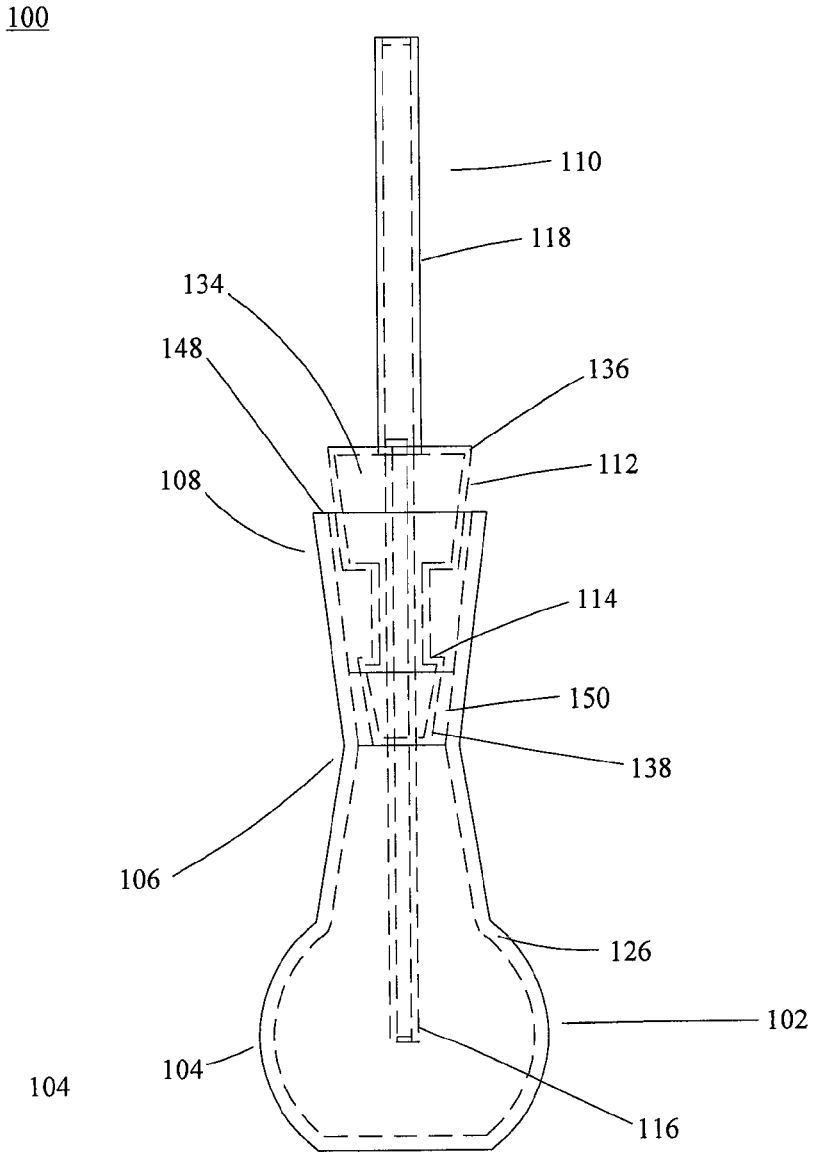
FIG. 8 is a front, revealed, perspective view of a hookah embodiment of the present invention.
Figure 10:
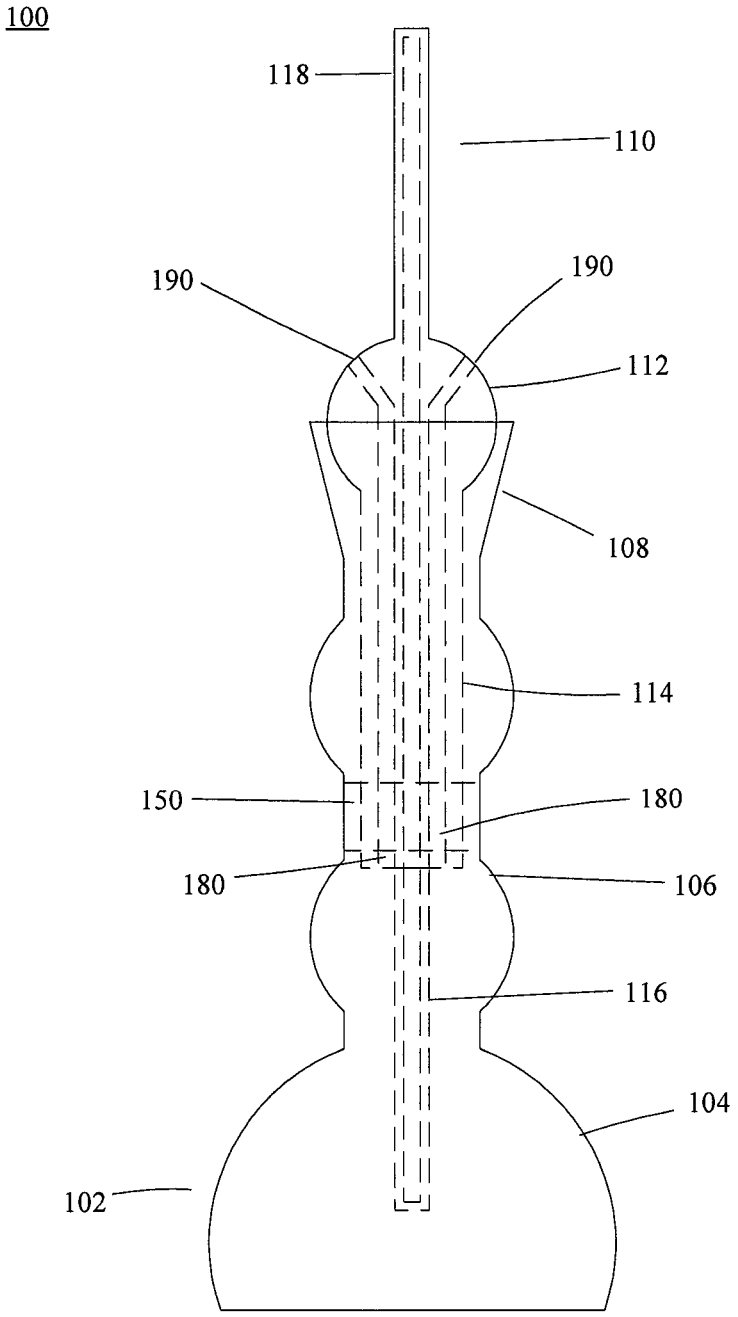
FIG. 10 is a front, revealed, perspective view of a hookah embodiment of the present invention.

As shown by FIG. 7, the stem 110 may attach to the bottle 102 with the aid of a single component, a seal 150. The present invention relies on multiple aspects to achieve its preferred sealing characteristics. The plunger sidewall 138 and bottle sidewall 126 proximate to the bottle neck 106 have complementary orientations. By complementary orientation it is meant that the plunger sidewall and neck sidewall include portions that face in a similar direction at least in the seal region of the bottle neck. By seal region it is meant that portion of the neck to which the stem 110 is meant to attach by means of the seal 150. The seal region can include complementary orientations for the length of the entire seal or for only the portion necessary to maintain a tight seal, even if the seal region includes merely a vertex of a gently sloping curve and the area immediately surrounding the same. The compressibility of the seal may accommodate slight discrepancies in orientations to still make the plunger and neck complementary. A preferred complementary orientation includes a plunger and neck that have parallel sidewalls as shown in FIG. 10, or sidewalls that taper at similar angles as shown in FIG. 8. The seal of the present invention may include any compressible material suitable to form an airtight barrier between the receptacle and the crown of the hookah bottle. The seal is similarly compressible and includes an area such that affixation of the stem to the interior of the hookah neck creates a self-supporting complex. In other words, the stem may be both affixed and retain its vertical orientation solely through the plunger-seal-neck attachment. The preferred seal includes a cylindrical elastic drum permanently bonded to the plunger with adhesive.

Returning to FIG. 7, another aspect of the fit of the present invention is the use of the gauge 112 to instruct the user as to the depth to which the plunger should descend within the bottle to affix at the seal region, also referred to as the indication level. Hookahs are constructed to be decorative as well as functional. Hookahs often include intricate bottles made of delicate material, including with decorative surface designs. The surface designs may include colored designs or material overlays that obscure the interior of the hookah. Furthermore, the material from which the bottle is constructed may be opaque to the degree that the interior is obscured. In any event, a user attempting to attach a hookah stem to the hookah bottle in an interior position may not have an acceptable view of the attachment. Hookahs are typically attached at the apex of the hookah bottle to a material, e.g. brass, steel, plastic, that differs from the bottle material, e.g. glass, crystal, etc. The present invention permits the bottle to be constructed of a unitary non-durable material such as glass or thin plastic and be attached via an interference fit to a durable material. In the case of a fragile bottle material, pressing a metal stem into a hookah bottle neck could result in the bottle shattering if pressed beyond a point that tolerates an interference fit. An interference fit is a fit between two components wherein a first component fits within the aperture of a second component and the aperture of the second component includes a diameter smaller than the diameter of the first component in order to retain the first component within the second component. In the case of a weak bottle material, pressing a metal stem into a hookah bottle neck could result in the bottle warping if pressed beyond a point that tolerates an interference fit. The art previously addressed the issue of component fitting with the use of a durable material bonded to the bottle that directly attached to the stem, which would generally be constructed of a durable material anyway, or the fragile material of which the bottle is composed would be reinforced with more of the same material. The present invention allows a bottle to have a substantially uniform sidewall girth.

The present invention solves the interior fit problem described above by use of a plunger 114 with a predetermined length and a gauge 112. The gauge 112 is preferably constructed to have a complementary shape and orientation as the crown 108 of the hookah bottle 102. The gauge 112 is meant to be an indicator of the depth of the seal 150 affixed to the plunger 114. The gauge is constructed to indicate by its position with the hookah crown 108 the proximity of the seal 150 to its position at the seal region. At the appropriate seal depth the gauge indicates by its proximity to the hookah crown. The preferred fit between the crown and the gauge is one of an open-clearance fit. An open clearance fit is a fit between two components wherein a surface of a first component approaches a surface of a second component such that the two surfaces approach, yet do not achieve, contact. The open-clearance fit can be a close open-clearance fit such that the components appear to be in contact, yet are spaced imperceptibly except on close inspection. Finally, the components can be in a contact fit where a portion of the gauge sidewall 136 contacts the sidewall 126 of the bottle 102 that corresponds to the bottle crown 108. FIG. 7 includes a conically flared crown sidewall that is complementary with the spherical gauge. The affixation between the plunge-seal-neck forms a fit that is self-supporting and does not rely on the affixation between the apex of a hookah bottle and a stem portion for support.

The preferred gauge-crown combination includes a crown with a slanting rim 148 as shown in FIG. 7. A slanting rim 148 permits a user to view the geometry of the gauge in greater detail. As hookahs may include inherently decorative aspects, it is a feature of the present invention that the gauge may indicate appropriate affixation depth by a decorative feature that lacks express indications of the appropriate fit relationship. One of the preferred means of depth indication uses inherent geometric components such as the maximum diameter of a sphere to be aligned with an inherent characteristic of the crown, such as the highest point of the rim or the lowest point of the rim or an approximate intermediate point. Alternatively, the crown and gauge may include express alignment markers that indicate the appropriate fit relationship. The marker may include lines, decorations, pictorial instructions, surface changes, material changes, design chances, etc.

Figure 9:
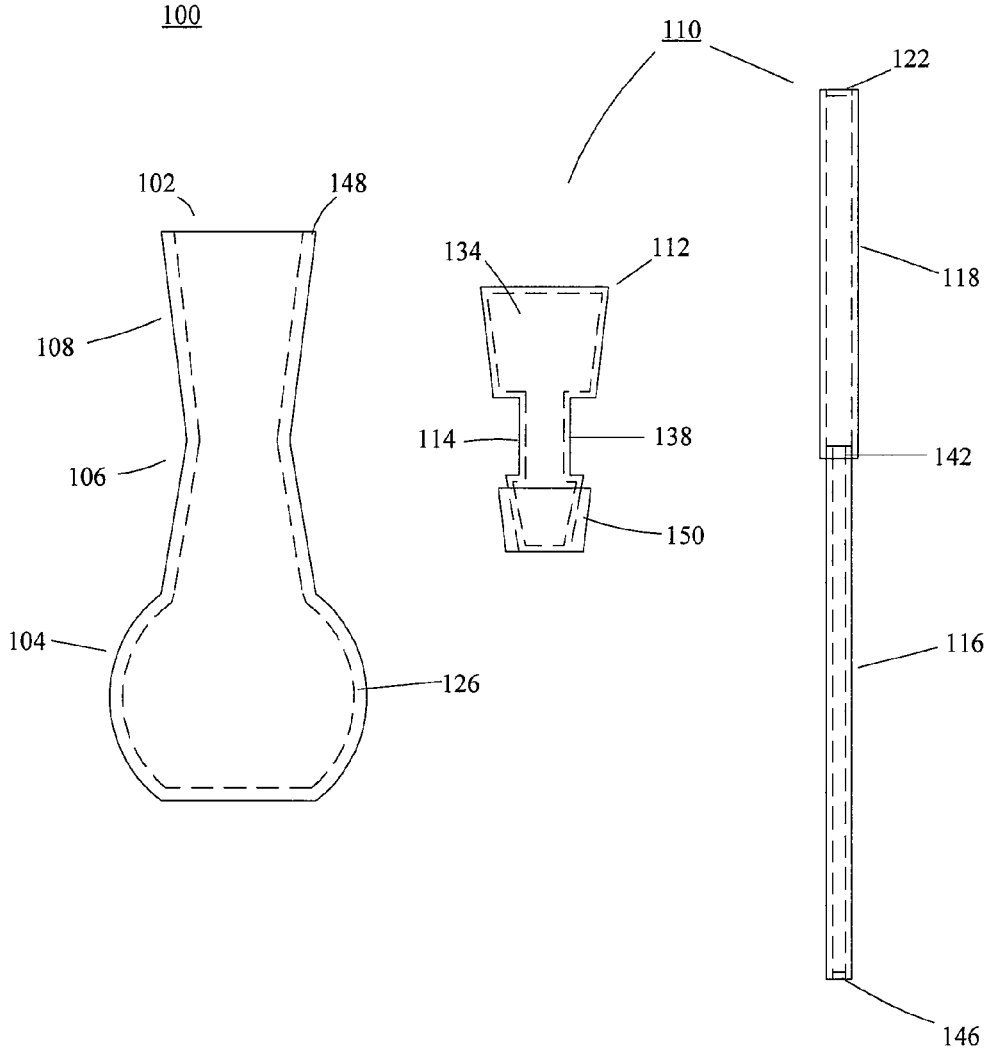
FIG. 9 is a front, revealed, perspective view of a hookah embodiment of the present invention disassembled.

Turning now to FIGS. 8 and 9, another embodiment of the hookah 100 is shown. The hookah 100 includes a stem 110 featuring a unitary dry smoke channel comprised of the dry smoke input 118 and the down tube 116. By unitary dry smoke channel, it is meant that the down tube 116 connects directly to the down tube 118 to deliver dry smoke through the plenum 134 without the need for the plenum to contact dry smoke. The down tube connects via the down tube upper end 142 to the interior of the dry smoke tube 118. Dry smoke may travel directly from the dry smoke tube inlet 122 to the down tube dry smoke outlet 146 without contacting the plenum. The preferred means of connection of the unitary dry smoke channel is between the lower portion of the dry smoke tube 118 exterior and the upper interior of the plenum 134. The plenum only contacts wet smoke that rises from the bottle 102.

The stem 110 includes a tapered gauge 112 and partially tapered plunger 114. Note that in the present embodiment, the plunger 114 includes a shape and orientation complementary to the shape and orientation of the bottle neck 106. At the point of affixation in the seal region (shown in FIG. 8 as point where the seal 150 operatively adheres the hookah stem to the bottle via interference fit) the plunger includes a conical shape that, with the aid of a seal 150, fits via interference fit within the conical cavity formed at the bottle neck 106. Similarly the gauge 112 includes a shape and orientation complementary to the shape and orientation of the bottle crown 108.

Figure 11:
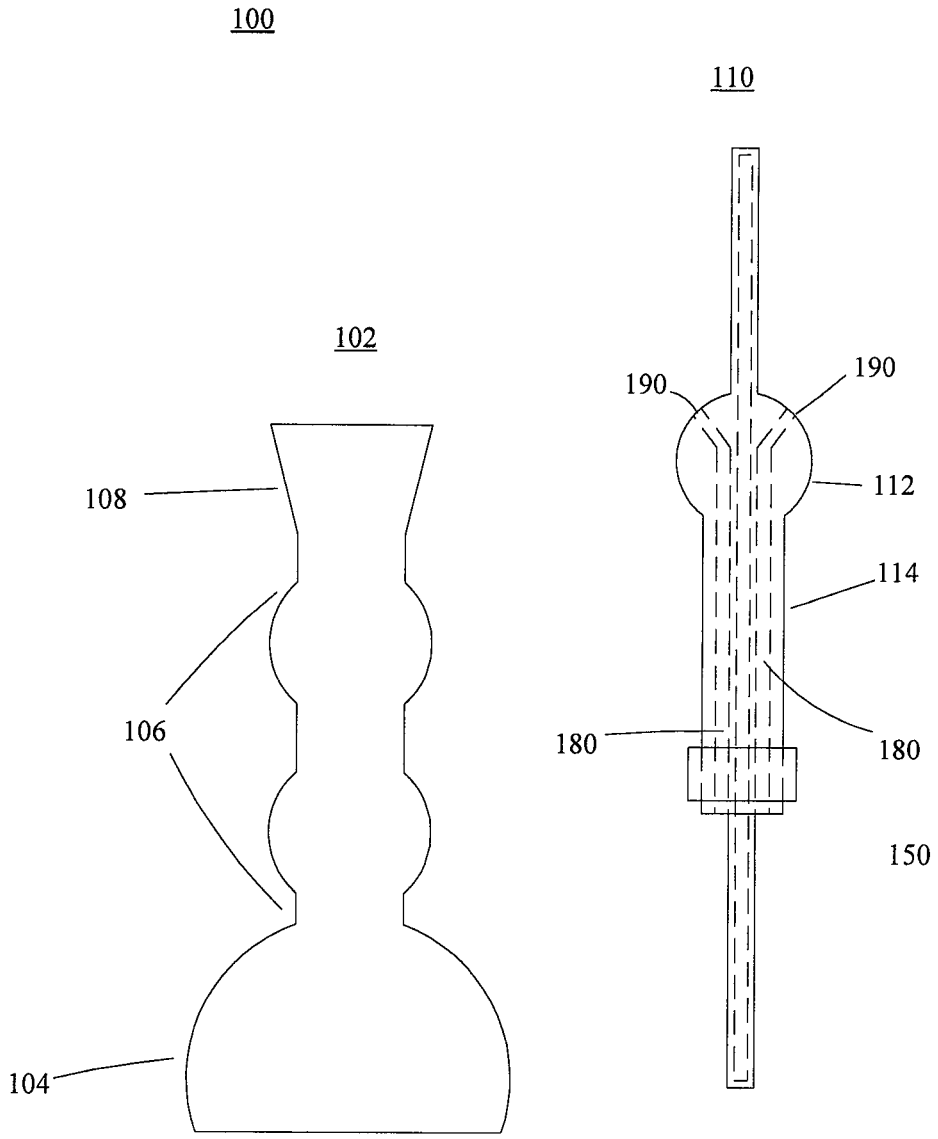
FIG. 11 is a front, revealed, perspective view of a hookah embodiment of the present invention disassembled.

Turning now to FIGS. 10 and 11, the hookah 100 of the present invention may include a bottle 102 that includes a neck 106 lacking a choke point. By choke point it is meant a narrow point in the bottle through which the plunger 114 and seal 150 cannot pass. In previously depicted embodiments of the present invention, the neck featured a region with a diameter smaller than can be tolerated with an interference fit. With the hookah of FIGS. 10 and 11, the seal 150 and corresponding seal region are calculated not to prevent warping/destruction of the bottle material, but rather to ensure that the stem 110 does not pass beyond the intended attachment point of the seal region (coextensive with 150). The seal region will be known a priori and the affixation depth will be determined and applied to the stem such that the stem will be constructed to ensure that the seal fits across a portion of the plunger beneath the gauge at an accurate affixation depth such that the gauge will properly indicate affixation at the seal region. It is further preferred that packaging or the hookah include instructions communicating to the user the indication level and means for achieving the fit of the present invention.

The hookah may include discrete and/or winding wet smoke channels 190 for the ascension of wet smoke from the hookah bottle 102 as the plenum. The hookah 102 may include a unitary stem 110 composed of a single integrated unit.

The neck 106 of the present invention will generally be characterized as the region of the bottle 102 having the smallest diameter. In the present invention, the neck 106 is meant to include at least that portion of the hookah bottle wherein the sidewall first converges to a diameter that may be contacted by the plunger 114 with the affixed seal 150. The neck 106 may include other dimensions unrelated to affixation for purposes of, for example, decoration. The hookah bottle of FIG. 10 by way of example, includes a parallel sidewall at the seal region, yet nonetheless includes bulges of greater, and varying, diameter above and below the seal region. The crown 108 will typically be flared upward toward the upper extremity. The boundary between the crown 108 and neck 106 may not be clear at a particular location; rather the crown and neck should be differentiated on the basis of their location, size, and function. The location of the neck will generally be under the crown, similarly the neck will generally be sized smaller than the crown; while the function is as described in this specification. The receptacle 104 will be sized generally to have a greater diameter than the neck and the crown in order to accommodate an effective amount of liquid.

Figure 12A:
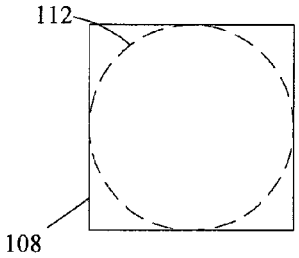
FIGS. 12*a-h* are top plan views of gauge and crown fits of the present invention.
Figure 12B:
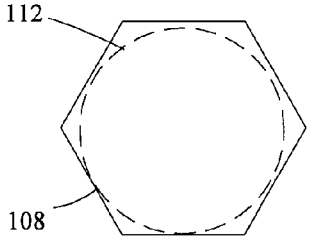
Figure 12C:
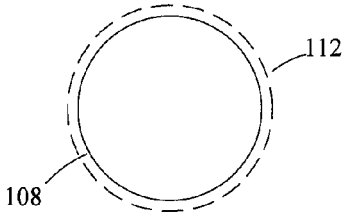
Figure 12D:
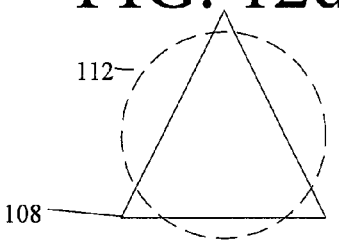
Figure 12E:
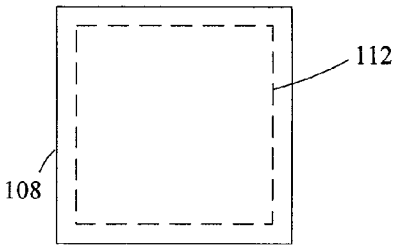
Figure 12F:
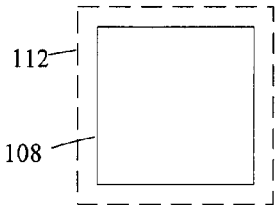
Figure 12G:
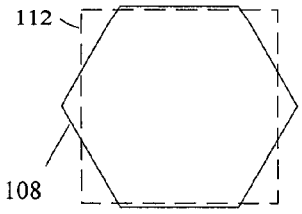
Figure 12H:
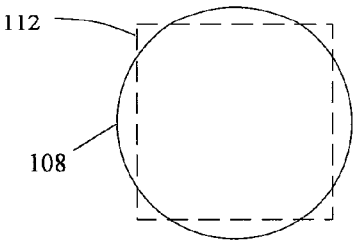

Turning now to FIGS. 12*a*-12*h*, exemplary crown 108 and gauge 112 (dashed lines indicate component only) dimensions are shown from an above view. In FIG. 12*a*, the gauge 112 fits into the crown 108 such that an indication level is formed at the appropriate affixation depth between the seal region. The indication level may include any of the following fits: an open clearance fit between the sidewall of the gauge and crown; or a contact fit between the sidewall of the gauge and crown wherein the gauge lightly contacts the crown sidewall or the rim. The present invention need not rely on any fit between the crown and gauge to support the stem. FIG. 12*b* shows an alternative crown 108 and gauge 112 arrangement. Like the previous arrangement, the crown and gauge are differing shapes; by complementary the crown and gauge sidewalls at the indication level need only be in partial contact, or near-contact. A circle/square and circle/hexagon may be complementary in an open clearance fit or contact fit relationship. As the gauge and crown are not relied upon to seal the hookah, which is sealed by the plunger/seal/neck affixation, there need not be a tight fit between gauge and crown. When the gauge has a maximum periphery diameter less than the periphery of the rim of the crown, then it is preferred that the maximum periphery diameter of the gauge be aligned with the rim as the indication level. As shown in FIGS. 12*c*-12*d*, the gauge 112 may include a maximum periphery larger than the periphery of the rim; in such instances, it is preferred that the gauge or crown include markings indicative of the indication level for the appropriate affixation depth or that the indication level is determined via a close contact fit between a portion of the gauge beneath the maximum gauge periphery and the crown, or that the indication level is determined via a close contact fit between a portion of the gauge beneath the maximum gauge periphery and the rim. FIGS. 12*e*-12*h* feature alternative fittings of the gauge 112 and crown 108.

Figure 13:
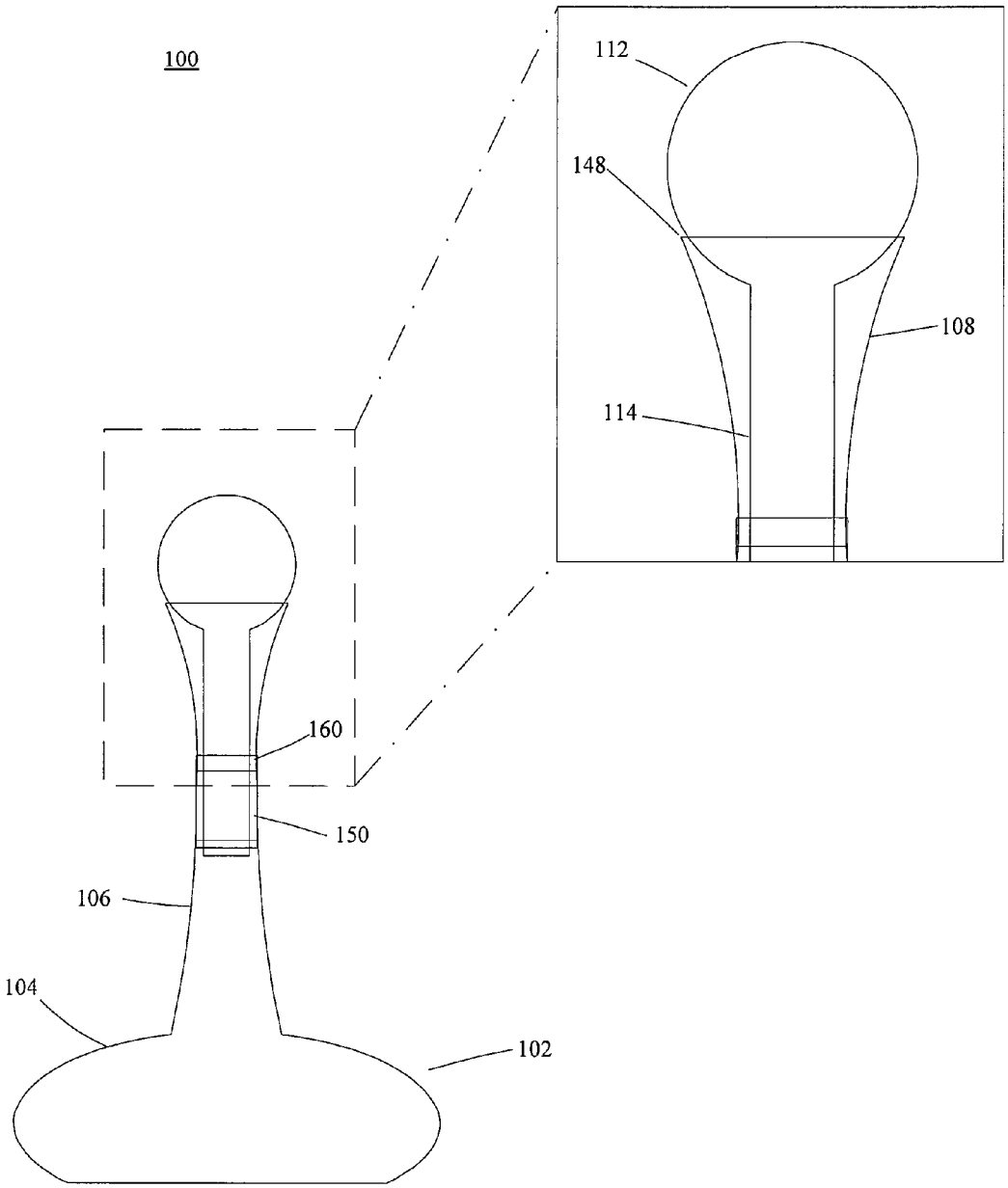
FIG. 13 is a front, revealed, perspective view of a hookah embodiment of the present invention with a partial view.
Figure 14:
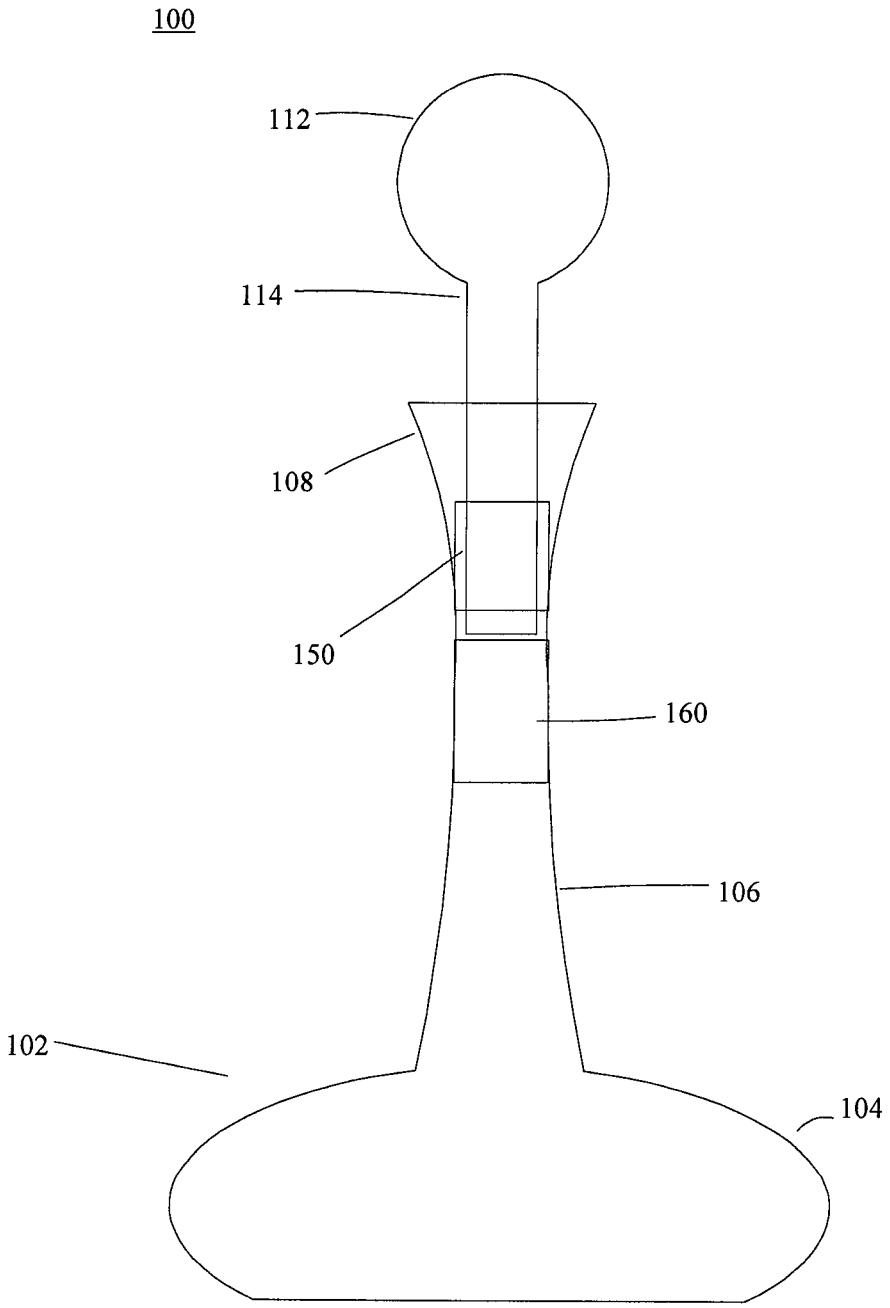
FIG. 14 is a front, revealed, perspective view of a hookah embodiment of the present invention.
Figure 15:
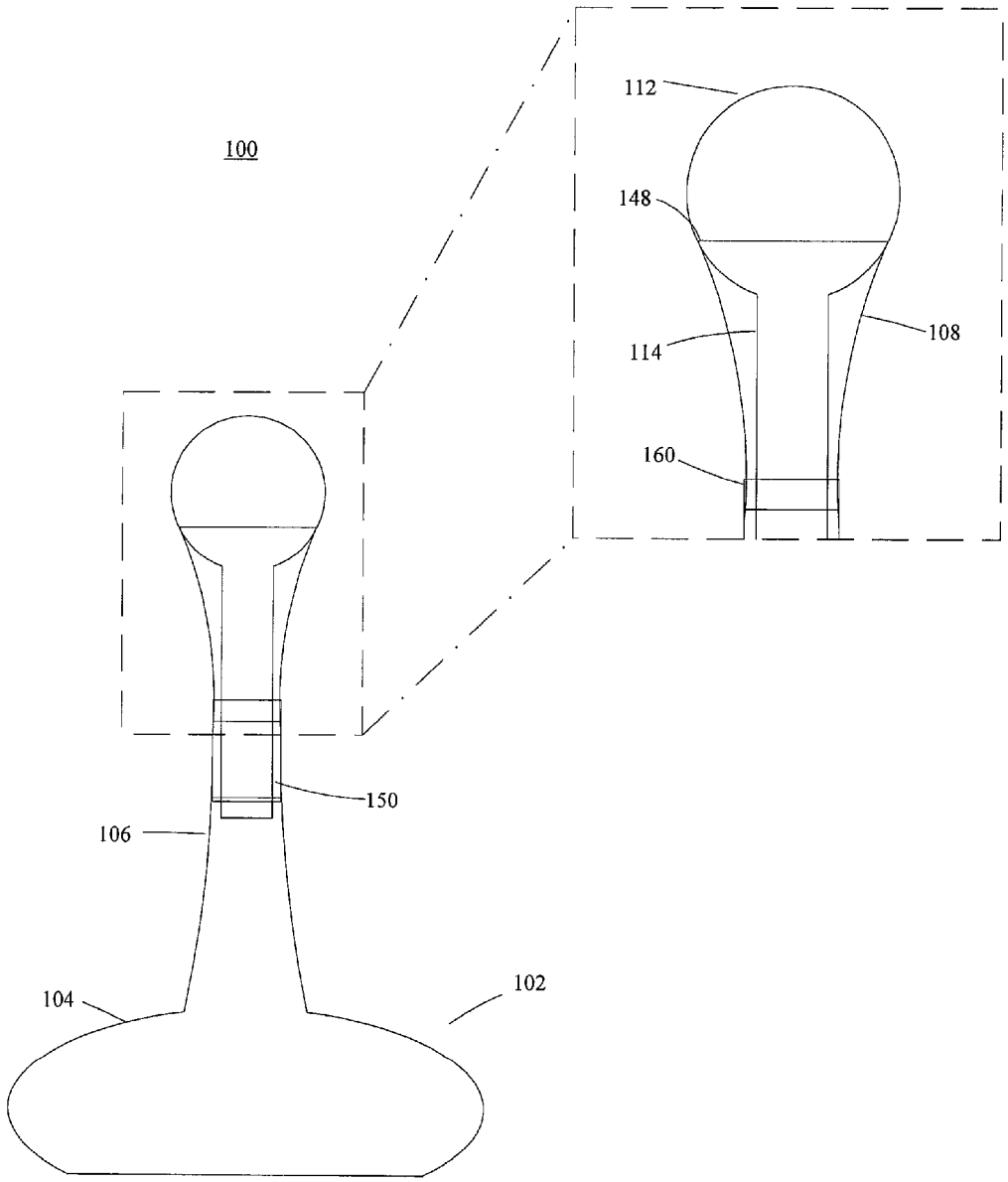
FIG. 15 is a front, revealed, perspective view of a hookah embodiment of the present invention with a partial view.

FIGS. 13-14 exhibit the indication level of the present invention that utilizes an open-clearance fit between a truncated stem depicting, for purposes of simplicity, merely the gauge 112 and plunger 114. The plunger includes a generally cylindrical shape to complement the generally cylindrical interior of the neck 106 seal region (which is coextensive with the seal 150 in FIG. 13). The gauge 112 includes a spherical shape that is complementary to the generally conical shape of the crown 108. As the gauge 112 and plunger 114 descend into the bottle 102, the gauge approaches to the sidewall of the crown 108. When the gauge and crown sidewall reach an open-clearance fit, then the plunger 114 has positioned the seal 150 at the appropriate affixation depth to adhere the seal 150 to the seal region. In this embodiment the seal region is contained within a surface design 160 of the neck, which obscures visibility to the seal region and the interior portion of the neck 106 beneath the surface design area. Glass and crystal in a heavily curved region often distort visibility into the interior of a container. Furthermore, glass can be obscured by a design formed by chemical frosting. Without the aid of the gauge, attachment of the hookah stem to the bottle 102 in an area not readily visible could be potentially destructive (if pressed down too far) or fail to achieve a seal (if not pressed down far enough). As can be seen the gauge fails to contact the rim 148 and the crown 108, yet the proximity is close enough to indicate an adequate seal. It may be important to prevent contact between the bottle material and the stem material, as the stem material for hookahs is generally rough and durable while bottle materials are generally delicate. As shown by FIG. 15, in other embodiments the indication level may be shown by a contact fit between the crown 108 and the gauge 112. The contact may be between the rim and the gauge, or the crown and the gauge.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hookah comprising:

a bottle with a solid sidewall, said bottle defining:

a receptacle with a downwardly-flared bottle sidewall portion to form a liquid reservoir;

a neck, above said receptacle, having a substantially parallel bottle interior wall portion;

a crown, above said neck, having an upwardly-flared bottle sidewall with a rim and defining a stem aperture;

a stem accumulator defining:

a plunger having a substantially parallel outer wall portion bearing a compressible seal dimensioned to form an interference fit at a seal region with said neck bottle interior wall portion and defining a wet smoke inlet in communication with a wet smoke conduit;

a gauge, above and integral to said plunger, defining an interior plenum in fluid communication with said wet smoke conduit and a wet smoke outlet, said gauge having a sidewall portion upwardly-flared and complementary with said crown sidewall to indicate an accurate affixation depth between said seal region and an open, clearance-fit relationship between said gauge sidewall portion and said crown sidewall below said rim.

2. The hookah of claim 1 wherein said crown sidewall is reflectively asymmetrical.

3. The hookah of claim 2 wherein said rim is vertically slanted.

4. The hookah of claim 3 wherein said rim includes a rim apex and rim nadir, and said gauge includes peripheral maximum; wherein said peripheral maximum, in said interference fit relationship, rests between said rim apex and rim nadir.

5. The hookah of claim 1 wherein said bottle sidewall includes a substantially opaque surface obscuring said seal region.

6. A hookah comprising:

a hookah bottle for accepting a liquid and having an upwardly flared crown sidewall terminating in a bottle rim surrounding a stem aperture, said crown above a bottle neck with a seal region having neck sidewall orientation, wherein said neck includes a neck diameter less than a stem aperture diameter;

a hookah stem defining:

a plunger, with a wet smoke conduit, having a plunger sidewall portion with a plunger sidewall orientation complementary to said neck sidewall orientation, said plunger sidewall portion bearing a compressible seal dimensioned to form an interference fit between said neck and said plunger sidewall portion; and a gauge, above and integral to said plunger, defining an interior plenum in communication with said wet smoke conduit and a wet smoke outlet, said gauge having a gauge sidewall portion upwardly-flared and complementary with said crown sidewall to indicate an accurate affixation depth from said seal region while forming an open, clearance-fit relationship between said gauge sidewall portion and said crown sidewall below said rim.

7. The hookah of claim 6 wherein said bottle sidewall includes a substantially opaque surface obscuring said seal region.

8. The hookah of claim 6 wherein said crown sidewall is reflectively asymmetrical.

9. The hookah of claim 8 wherein said rim is slanted.

10. The hookah of claim 9 wherein said rim includes a rim apex and rim nadir, and said gauge includes a peripheral maximum; wherein said peripheral maximum, in said interference fit relationship, rests between said rim apex and rim nadir.

11. The hookah of claim 6 wherein said neck at said seal region includes substantially parallel sidewalls.

12. The hookah of claim 11 wherein said gauge is bulbous.

13. The hookah of claim 12 wherein said gauge includes a peripheral maximum; wherein said peripheral maximum, in said interference fit relationship, rests substantially coplanar to said rim.

14. The hookah of claim 6 defining a dry smoke tube adapted to releasably affix to said gauge; and a down tube, adapted to releasably affix to said dry smoke tube and extend through said plenum beyond said plunger into said bottle.

15. The hookah of claim 14 wherein down tube affixes interiorly to said dry smoke tube and wherein said dry smoke tube affixes exteriorly to said gauge.

16. A hookah comprising:

a hookah bottle for accepting a liquid and having an upwardly flared crown sidewall terminating in a bottle rim surrounding a stem aperture, said crown above a bottle neck with a seal region having neck sidewall orientation, wherein said neck includes a neck diameter less than a stem aperture diameter and said bottle neck includes is substantially opaque to obscure said seal region;

a hookah stem defining:

a plunger, with a wet smoke conduit, having a plunger sidewall portion with a plunger sidewall orientation complementary to said neck sidewall orientation, said plunger sidewall portion bearing a compressible seal dimensioned to form an interference fit between said neck and said plunger sidewall portion; and a gauge, above and integral to said plunger, defining an interior plenum in communication with said wet smoke conduit and a wet smoke outlet, said gauge having a gauge sidewall portion upwardly-flared and complementary with said crown sidewall to indicate an accurate affixation depth from said seal region while forming an open, clearance-fit relationship between said gauge sidewall portion and said crown sidewall below said rim.

17. The hookah of claim 16 wherein said crown sidewall and said neck sidewall include a substantially continuous girth.

18. The hookah of claim 17 wherein said bottle is constructed of a single material.

19. The hookah of claim 16 wherein said crown sidewall is reflectively symmetrical.

* * * * *